US007565969B2

(12) United States Patent
He

(10) Patent No.: US 7,565,969 B2
(45) Date of Patent: Jul. 28, 2009

(54) MOISTURE RESISTANT CIGARETTE PACKAGE

(76) Inventor: Wen-Tian He, 4C, No. 2 Baihui Commercial Center, Songbaitang, Changping Town, Dongguan, Guangdong 523561 (CN)

( * ) Notice: Subject to any disclaimer, the term of this patent is extended or adjusted under 35 U.S.C. 154(b) by 53 days.

(21) Appl. No.: 11/705,040

(22) Filed: Feb. 12, 2007

(65) Prior Publication Data

US 2007/0246383 A1 Oct. 25, 2007

(30) Foreign Application Priority Data

Feb. 27, 2006 (CN) ..... 2006 1 0033986

(51) Int. Cl.
*A24F 15/00* (2006.01)

(52) U.S. Cl. ..... 206/251; 206/249; 206/259

(58) Field of Classification Search ..... 206/249, 206/250, 251, 259; D27/183, 186, 189
See application file for complete search history.

(56) References Cited

U.S. PATENT DOCUMENTS 1,026,453 A * 5/1912 Phillippar et al. ..... 206/250
1,048,285 A * 12/1912 Brand ..... 206/126
1,735,323 A * 11/1929 Enfant ..... 206/251
1,735,325 A * 11/1929 Enfant ..... 229/160.1
1,853,760 A * 4/1932 Davis ..... 206/259
1,919,100 A * 7/1933 Field ..... 229/160.1
1,992,373 A * 2/1935 Johnson ..... 206/268
2,390,945 A * 12/1945 Kleinberg ..... 206/250
2,833,455 A * 5/1958 Planas ..... 229/125.11
3,052,398 A * 9/1962 Lewin ..... 229/125.37
3,583,625 A * 6/1971 Gero ..... 206/264
3,749,234 A * 7/1973 Gero ..... 206/266
3,881,599 A * 5/1975 Flaherty ..... 206/273

* cited by examiner

*Primary Examiner*—J. Gregory Pickett

(57) ABSTRACT

A cigarette package includes a hinged cover including two opposite projections on front and rear walls respectively, a fixed inner casing including an oblique opening facing the hinge, a first shoulder at a lower edge of each of front and rear walls thereof, and two opposite cavities on the front and rear walls thereof respectively, a sliding cigarette insert block in the casing and including a hook extending from an underside, and a pivot mechanism secured to the cover and including a bottom plate connected to the hinge and extending into a space defined by the hook and the cigarette insert block, and a second shoulder at a top edge of each of front and rear walls thereof. Pivoting the cover to disengage the projections with the cavities will pivot the bottom plate to move the cigarette insert block upward until tabs of the second shoulders contact the first shoulders.

1 Claim, 7 Drawing Sheets

MOISTURE RESISTANT CIGARETTE PACKAGE

BACKGROUND OF THE INVENTION

1. Field of Invention

The invention relates to cigarette packages, and more particularly to such a cigarette package having a pivot mechanism for sealingly closing the package so that the package can be more resistant to moisture for the protection of cigarettes contained therein.

2. Description of Related Art

There have been numerous suggestions in prior patents for cigarette package. For example, U.S. Pat. No. 4,793,478 discloses a cigarette package for allowing the extraction of cigarettes one at a time without disturbing other cigarettes in the package.

It is known that moisture tends to enter an open cigarette package. Further, cigarettes in the open package may get mildewed. As such, the cigarettes may be not sanitary and are of no use. Hence, a need has arisen for a moisture resistant cigarette package.

SUMMARY OF THE INVENTION

It is therefore one object of the invention to provide a cigarette package having a pivot mechanism for sealingly closing the package so that the package can be more resistant to moisture for the protection of cigarettes contained therein.

The above and other objects, features and advantages of the invention will become apparent from the following detailed description taken with the accompanying drawings.

DETAILED DESCRIPTION OF THE INVENTION

Figure 1:
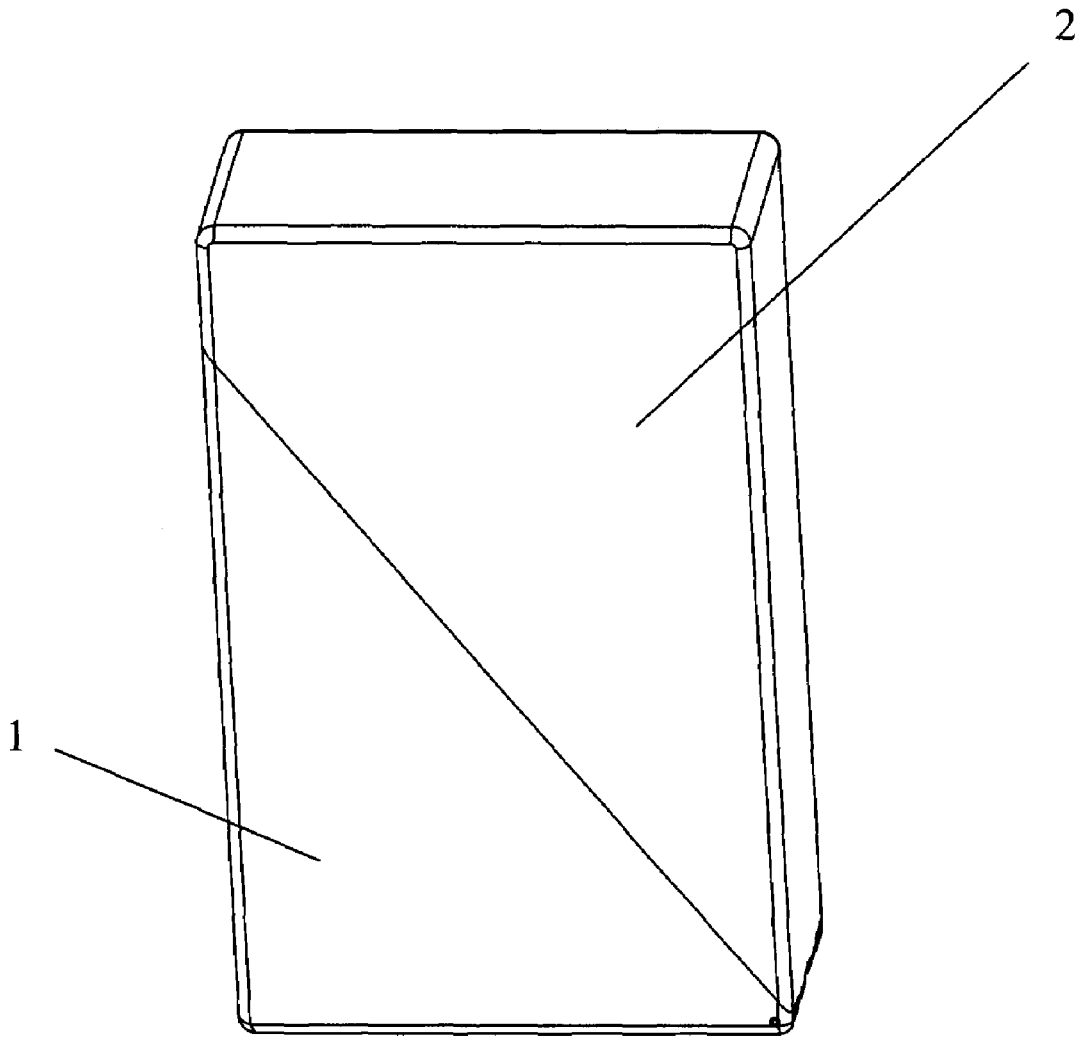
FIG. 1 is a perspective view of a preferred embodiment of cigarette package according to the invention where the package is closed.
Figure 2:
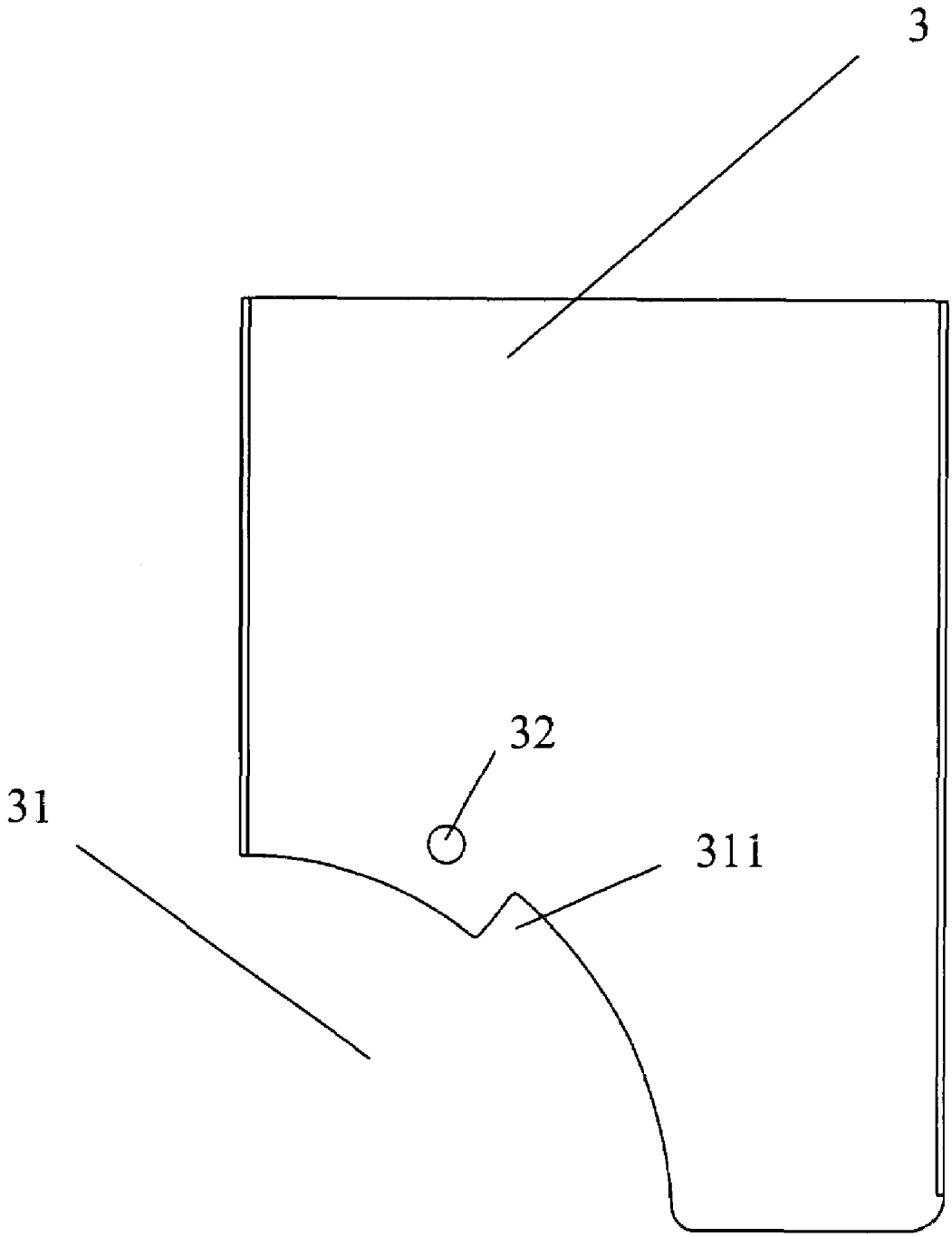
FIG. 2 is a side view of casing as an internal component of the package.
Figure 3:
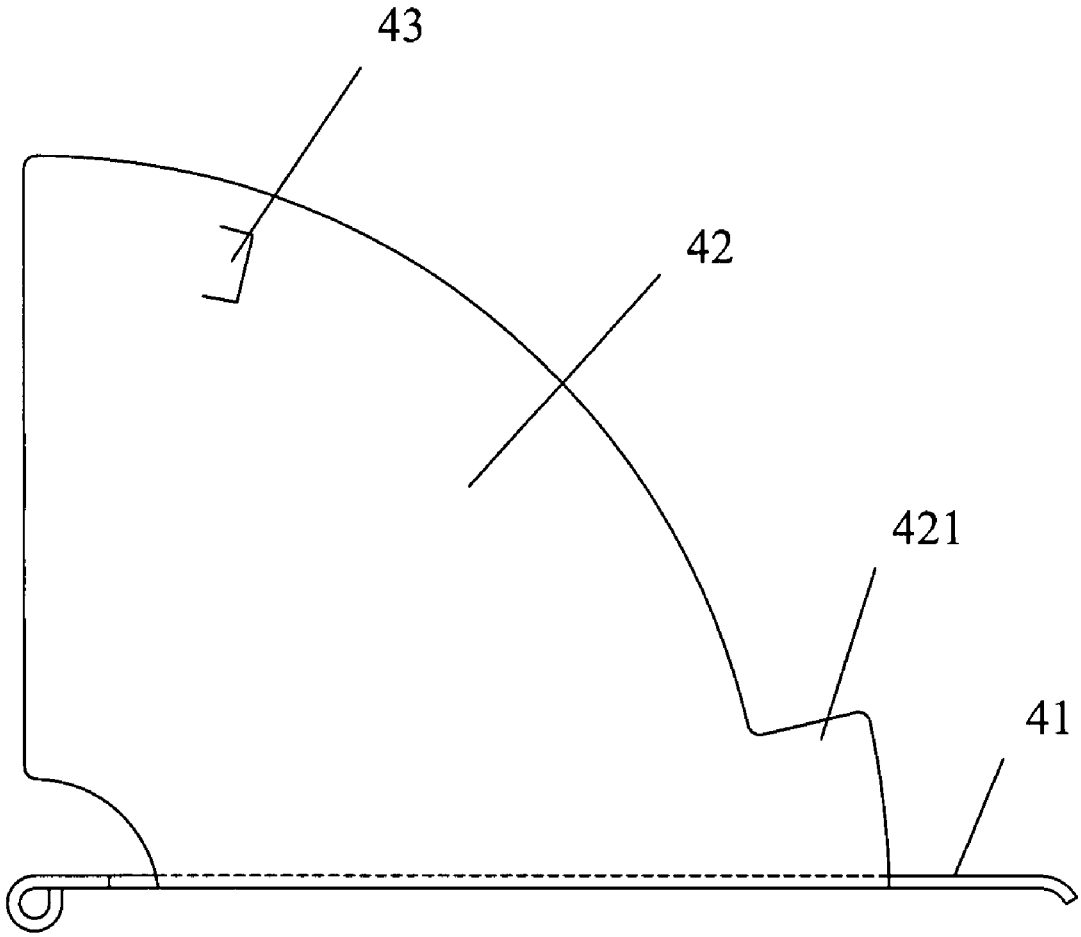
FIG. 3 is a side view of pivot mechanism as an internal component of the package.
Figure 4:
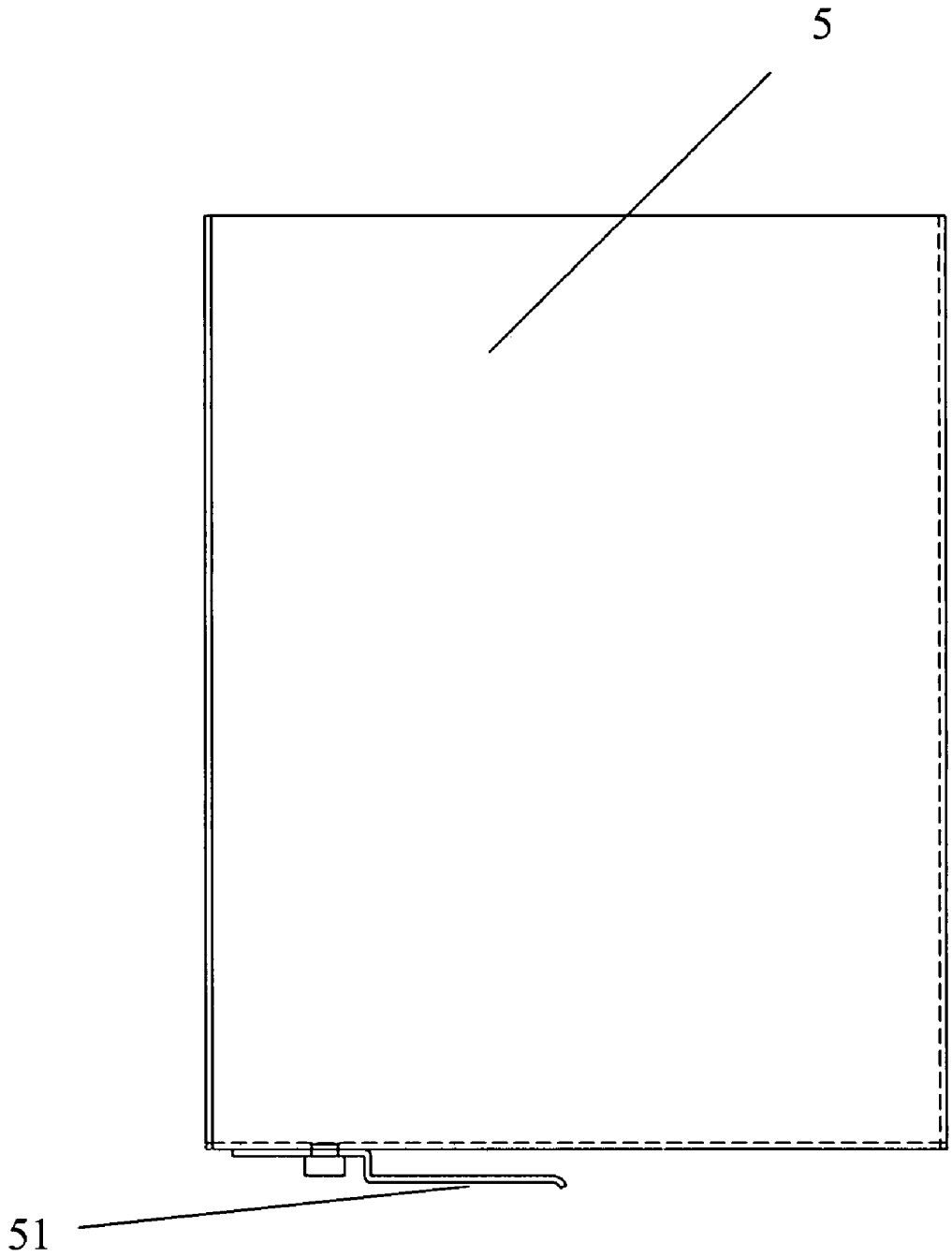
FIG. 4 is a side view of cigarette holding insert block section as an internal component of the package.

Referring to FIGS. 1 to 7, a cigarette package in accordance with a preferred embodiment of the invention comprises a box 1 and a cover 2 having a lower end hingedly connected to one bottom side of the box 1. The cover 2 comprises two opposite first cavities 21 on inner surfaces of its front and rear walls respectively, and two opposite first projections 22 having a rounded head projecting inwardly from its front and rear walls respectively. Each of the box 1 and the cover 2 can be made of almost any suitable material such as metal, plastics, or cardboard.

The cigarette package further comprises the following components. A rectangular metal casing 3 is sized and configured to fixedly fit in an enclosure defined by the box 1 and is open to top and bottom ends. The casing 3 comprises an oblique opening 31 at a bottom corner facing the hinge, a first shoulder 311 at about a midpoint of either curved edge of the opening 31,.and two opposite second cavities 32 on its front and rear walls respectively.

A rectangular cigarette holding insert block section 5 is sized and configured to moveably fit in an enclosure defined by the casing 3 and comprises a blind bottom end, an open top end, and a hook 51 secured to an underside.

A pivot mechanism 4 is open to a top and substantially mates with the casing 3. The pivot mechanism 4 comprises a rectangular bottom plate 41 having one side hingedly connected to one bottom side of the box 1 and the other side extending into a space defined by the hook 51 and the underside of the cigarette holding insert block section 5, front and rear walls 42 having a curved edge terminated at an edge of the open top of the pivot mechanism 4, each of the front and rear walls 42 having a second shoulder 421 at its curved edge proximate the bottom plate 41, the second shoulder 421 having an inwardly extending tab (not shown), and two opposite second projections 43 projecting outwardly from its front and rear walls respectively. The second projections 43 are lockingly engaged with the first cavities 21 so that the cover 2 and the pivot mechanism 4 can pivot as a whole. Moreover the bottom plate 41 is substantially perpendicular to the hinged side of the cover 2. Further, the bottom plate 41 has a length about half of the width of the casing 3 (see FIG. 6).

The first projections 22 are matingly engaged with the second cavities 32, one or more cigarettes are contained in the cigarette holding insert block section 5, and the bottom of the cigarette holding insert block section 5 is proximate the bottoms of the box 1 and the casing 3 when the package is closed.

Figure 5:
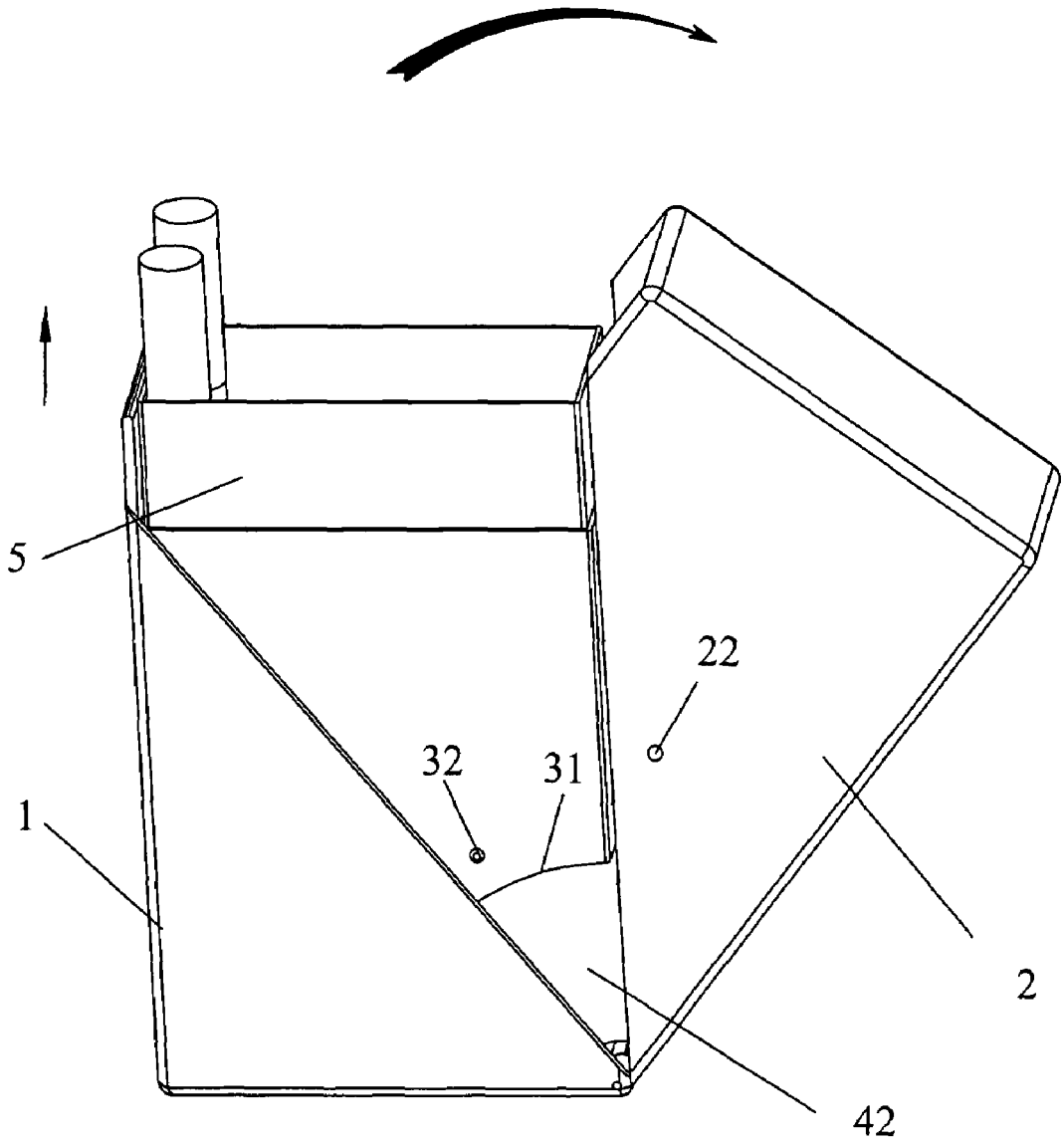
FIG. 5 is another perspective view of the cigarette package which is being opened.
Figure 6:
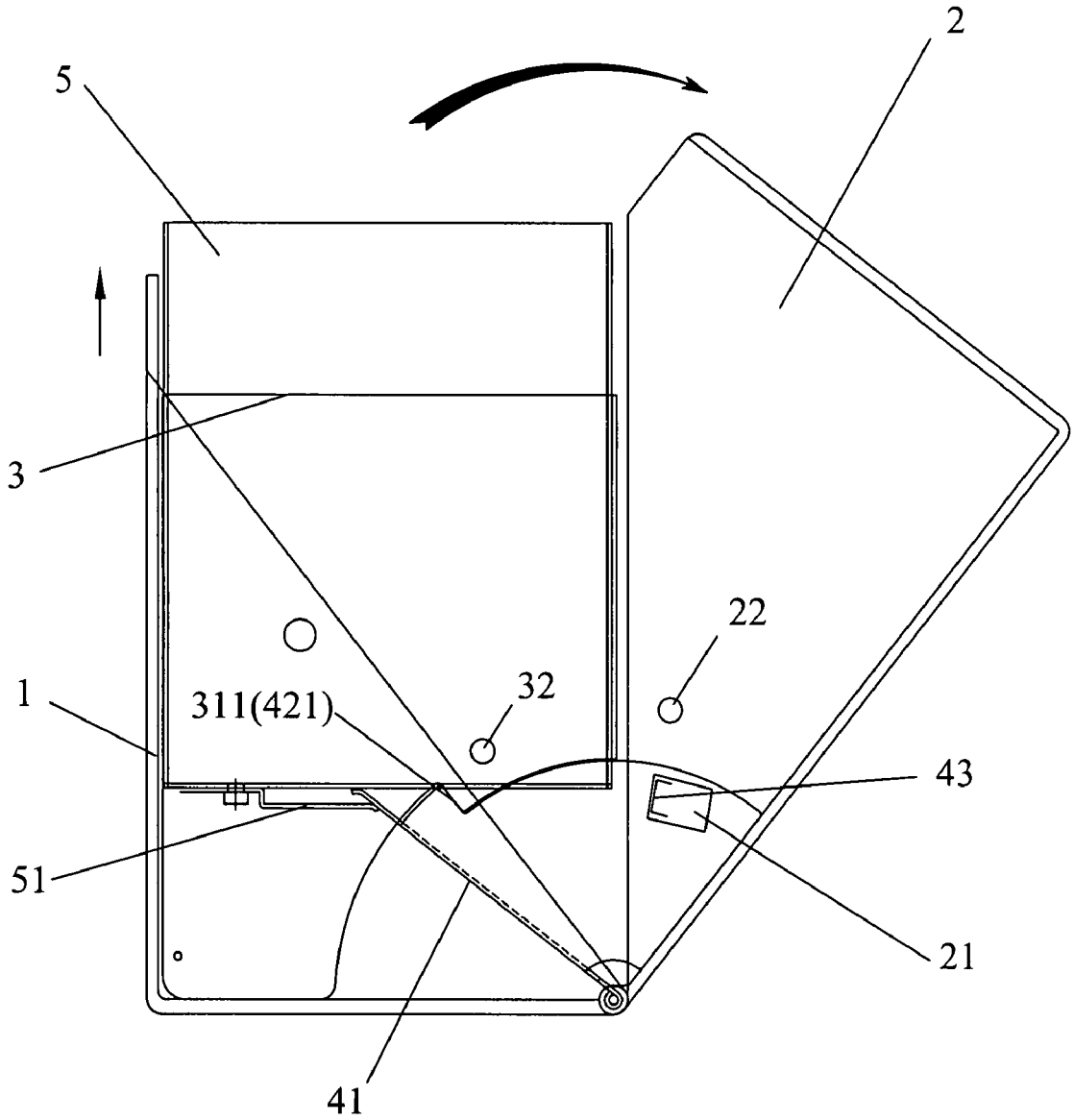
FIG. 6 is a side view of FIG. 5 schematically showing a mechanism for opening the package.

Referring to FIGS. 5 and 6 specifically, a package opening operation of the invention will be described in detailed below. A person can pivot the cover 2 about the hinge to open the package by easily causing the first projections 22 to clear the second cavities 32 as indicated by arrow in FIG. 5 or FIG. 6. Also, the cigarette holding insert block section 5 slowly moves upward as the bottom plate 41 clockwise pivots due to the engagement of the bottom plate 41 and the hook 51. The opening operation will be stopped when the tabs of the pivoting second shoulders 421 contact the first shoulders 311. At this position, the cigarette holding insert block section 5 also projects from tops of the casing 3 and the box 1 with the cigarettes being exposed for ease of taking out.

Figure 7:
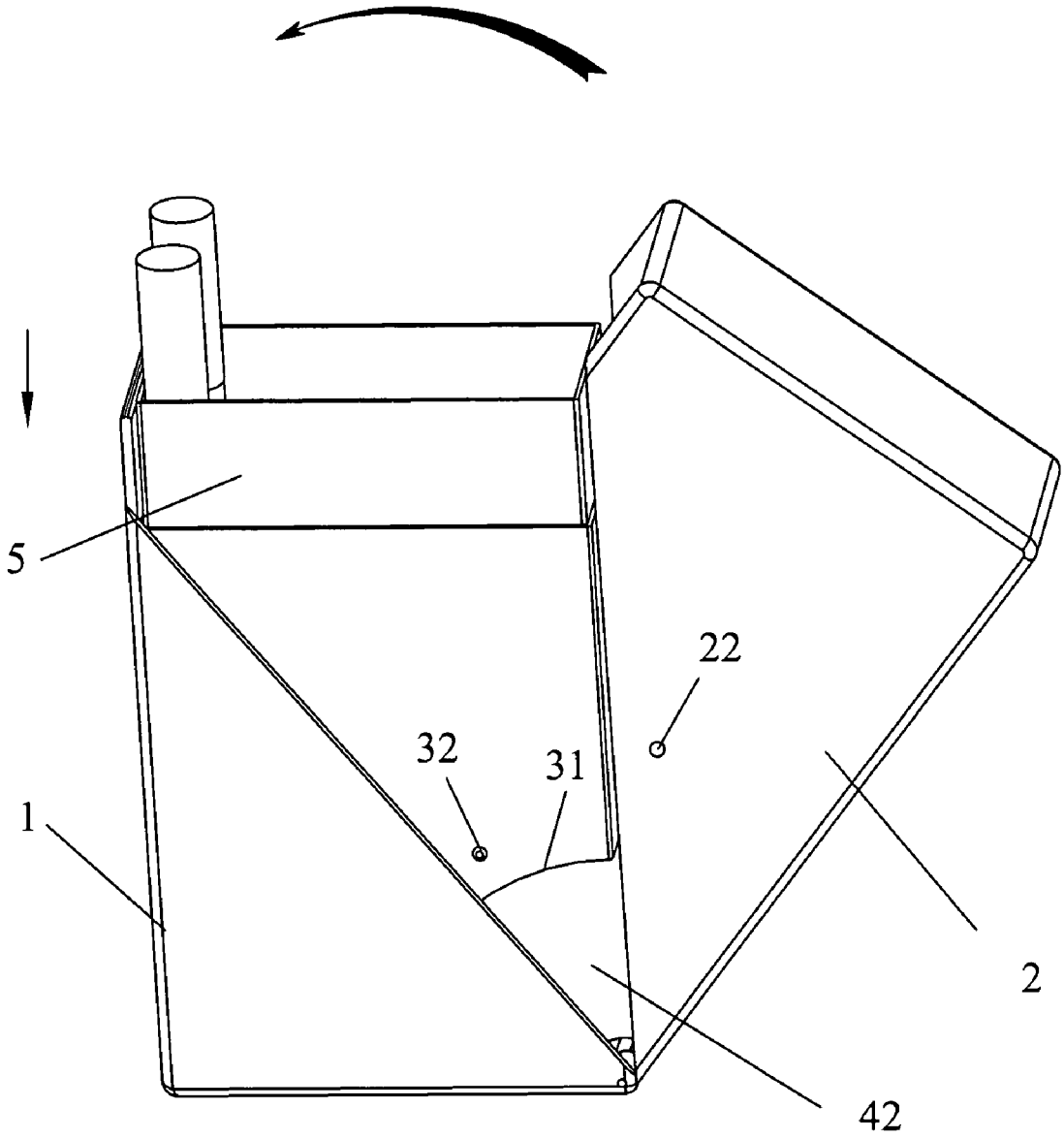
FIG. 7 is a view similar to FIG. 5 where the package is being closed.

Referring to FIG. 7 specifically, a package closing operation of the invention will be described in detailed below. After taking out one or more cigarettes, the person can counterclockwise pivot the cover 2 and thus the pivot mechanism 4 until a peripheral ledge of the cover 2 engages with a corresponding peripheral ledge of the box 1 and the first projections 22 engage with the second cavities 32. The cigarette holding insert block section 5 moves downward slowly during the pivoting until returning to its closed position.

While the invention herein disclosed has been described by means of specific embodiments, numerous modifications and variations could be made thereto by those skilled in the art without departing from the scope and spirit of the invention set forth in the claims.

What is claimed is:

1. A cigarette package comprising: a box; a cover mated with the box and including front and rear walls, a hinge connected to one side of a bottom of the box, and two opposite projections projecting inwardly from inner surfaces of the front and rear walls thereof respectively; a casing fixedly fit in an enclosure defined by the box and being open to top and bottom ends, the casing including front and rear walls, an oblique opening facing the hinge, a first shoulder at a predetermined position other than both ends of a lower edge of each of the front and rear walls thereof, and two opposite cavities on the front and rear walls thereof respectively; a cigarette holding insert block section moveably fit in an enclosure defined by the casing and including a blind bottom end, an open top end, and a hook extending from an underside; and pivot means secured to the cover and including an open top, a bottom plate having one side connected to the hinge and the other side extending into a space defined by the hook and the underside of the cigarette holding insert block section, and front and rear walls each having a second shoulder at a predetermined position other than both ends of a top edge thereof, the second shoulder having an inwardly extending tab, wherein the projections are engaged with the cavities when the cover is closed onto the box, and in response to disengaging the projections with the cavities by clockwise pivoting the cover, the bottom plate clockwise pivots to move the cigarette holding insert block section upward until the tabs of the second shoulders contact the first shoulders.

* * * * *